US008469758B2

(12) United States Patent
Honda et al.

(10) Patent No.: US 8,469,758 B2
(45) Date of Patent: Jun. 25, 2013

(54) INSULATOR FOR SPARK PLUG, AND METHOD FOR MANUFACTURING SPARK PLUG

(75) Inventors: Toshitaka Honda, Aichi (JP); Hirokazu Kurono, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 69 days.

(21) Appl. No.: 13/280,428

(22) Filed: Oct. 25, 2011

(65) Prior Publication Data

US 2012/0055018 A1 Mar. 8, 2012

Related U.S. Application Data

(62) Division of application No. 12/393,413, filed on Feb. 26, 2009, now abandoned.

(30) Foreign Application Priority Data

Feb. 27, 2008 (JP) ..... P2008-045515
Jan. 7, 2009 (JP) ..... P2009-001217

(51) Int. Cl.
*H01T 21/00* (2006.01)
*H01T 21/02* (2006.01)

(52) U.S. Cl.
USPC ..... 445/7

(58) Field of Classification Search
USPC ..... 445/7
See application file for complete search history.

(56) References Cited

U.S. PATENT DOCUMENTS 7,432,641 B2 * 10/2008 Nunome ..... 313/141

FOREIGN PATENT DOCUMENTS

| | | | |
|---|---|---|---|
| EP | 2103402 | A2 * | 9/2009 |
| JP | 2000-058226 | | 2/2000 |
| JP | 2000-315563 | | 11/2000 |
| JP | 2002305069 | A * | 10/2002 |

OTHER PUBLICATIONS

Office Action issued on Dec. 18, 2009 in corresponding Japanese Patent App. No. JP 2009-001217; 12 pages total (includes English translation).

* cited by examiner

*Primary Examiner* — Mariceli Santiago
(74) *Attorney, Agent, or Firm* — Kusner & Jaffe

(57) ABSTRACT

A method for manufacturing an insulator includes: preparing a press pin and a forming die having a cavity, the press pin including a pin-side spiral portion formed on a first position; filling a raw powder into the cavity; arranging the press pin within the cavity; pressing the raw powder within the cavity along with the press pin, and obtaining a green body formed with a green body-side spiral portion; releasing the green body along with the press pin from the cavity; retreating the press pin with respect to the green body while rotating the press pin relative to the green body around an axis, and extracting the press pin from the green body; and removing an unnecessary portion from the green body. The first position is positioned such that the green body-side spiral portion is located in the unnecessary portion of the green body.

3 Claims, 12 Drawing Sheets

INSULATOR FOR SPARK PLUG, AND METHOD FOR MANUFACTURING SPARK PLUG

This application is a divisional of application Ser. No. 12/393,413 filed on Feb. 26, 2009 now abandoned.

CROSS-REFERENCE TO RELATED APPLICATIONS

This application is based upon and claims priority from Japanese Patent Application No. 2008-045515 filed on Feb. 27, 2008 and Japanese Patent Application No. 2009-001217 filed on Jan. 7, 2009, the entire contents of which are incorporated herein by reference.

FIELD OF THE INVENTION

The present invention relates to an insulator for a spark plug, and a method for manufacturing the spark plug.

BACKGROUND OF THE INVENTION

JP-A-2000-58226 describes a method for manufacturing an insulator for a spark plug. This method is for manufacturing an insulator for a spark plug, which insulator has a through hole for inserting a center electrode and a terminal electrode extending in an axial direction. The insulator further includes a thick-walled portion having large wall thickness defined between the through hole and an outer peripheral surface.

In this manufacturing method, first, as a preparing step, a press pin used to form a through hole, and a forming die having a cavity are prepared. On the base end side of the press pin, a rib-shaped pin-side spiral portion is formed on an outer peripheral surface.

Also, as a press pin arranging step, the press pin is arranged within the cavity by advancing a leading end of the press pin in the axial direction. Next, as a powder filling step, a raw powder is filled into the cavity in which the press pin is arranged. Then, as a pressing and forming step, the raw powder within the cavity is pressed along with the press pin, and a green body is obtained. A base end of this green body is formed with a green body-side spiral portion to which a pin-side spiral portion of the press pin is transferred.

After the pressing and forming step, as a die releasing step, a green body along with the press pin is released from the cavity. After the die releasing step, as a press pin removing step, the press pin is withdrawn with respect to the green body while being rotated around an axis, and the press pin is extracted from the green body. Then, as shown in FIG. 11 of JP-A-2000-58226, as an unnecessary portion removing step, an unnecessary portion is removed from the green body. In this case, the green body-side spiral portion remains at the base end of the green body after the unnecessary portion has been removed. This unnecessary portion removing step may be performed by temporarily sintering the green body after the press pin removing step. The green body obtained in this way is finished to an external shape corresponding to an insulator for a spark plug.

Then, the green body is sintered at a temperature of 1400 to 1650° C. Thereby, a pin hole formed by the press pin becomes a through hole. Then, the sintered body is finished and sintered by applying glaze to the surface thereof, whereby an insulator for a spark plug is obtained. In addition, as shown in FIG. 1 of JP-A-2000-58226, the green body-side spiral portion remains at the base end of the through hole. This insulator for a spark plug becomes a spark plug in which a center electrode, a terminal electrode, a metal shell, a resistor, etc. are provided. The thick-walled portion of the insulator for a spark plug is located within the metal shell. This spark plug is attached to an engine at a thread portion of the metal shell, and is used as an igniting source for an air-fuel mixture to be supplied to a combustion chamber of the engine.

BRIEF SUMMARY OF THE INVENTION

There is a need to reduce a diameter of the spark plug for reducing the space for an engine. Due to this, there is also a need to further reduce a diameter of an insulator for a spark plug (for example, the external diameter of a portion exposed to the base end of the metal shell becomes 10 mm or less). When such an insulator for a spark plug is manufactured by the above-described manufacturing method, the strength of the green body or the insulator for a spark plug may deteriorate.

This is because, in the above-described manufacturing method, the green body-side spiral portion remains at the base end of the green body after an unnecessary portion has been removed, and the wall thickness of the base end of the green body becomes small by the green body-side spiral portion.

The deterioration of strength of the green body may easily cause troubles at the green body, such as breakage, during the die releasing step, the press pin removing step, etc. Even if breakage or the like does not occur in the green body, the deterioration of strength occurs in the insulator for a spark plug, and troubles, such as breakage, occur at the insulator for the spark plug, for example, when the spark plug is assembled. In this case, a decrease in yield may be caused. Even if a spark plug has been completed, the spark plug can also become a factor of troubles after the completion, such that a tool for attaching the spark plug strikes and breaks the spark plug at the time of attachment of the spark plug to an engine.

The present invention was made in view of the above-described circumstances, and an object thereof is to provide a method for manufacturing an insulator for a spark plug capable of securing high yield even if the diameter of the insulator is made small.

According to a first aspect of the invention, there is provided a method for manufacturing an insulator for a spark plug which has a through hole extending in an axial direction for receiving a center electrode and a terminal electrode, said method comprising: preparing a press pin for forming the through hole and a forming die having a cavity, the press pin comprising a rib-shaped pin-side spiral portion formed on an outer peripheral surface of a first position of the press pin; filling a raw powder into the cavity; arranging the press pin within the cavity by advancing a leading end of the press pin in the axial direction before, during, or after filling the raw powder; pressing the raw powder within the cavity along with the press pin, and obtaining a green body formed with a green body-side spiral portion to which a shape of the pin-side spiral portion is transferred, after arranging the press pin; releasing the green body along with the press pin from the cavity, after forming the green body; withdrawing the press pin with respect to the green body while rotating the press pin relative to the green body around an axis, and extracting the press pin from the green body, after releasing the die; and removing an unnecessary portion from the green body after removing the press pin, wherein the first position of the press pin is positioned during forming of the green body such that the green body-side spiral portion is located in the unnecessary portion of the green body.

In the manufacturing method of the first aspect, the first position in the press pin where the pin-side spiral portion is formed is set such that the green body-side spiral portion is located in the unnecessary portion of the green body. For this reason, the green body-side spiral portion does not remain as part of the green body after the unnecessary portion has been removed. For this reason, the wall thickness of the green body is not reduced by the green body-side spiral portion. As a result, the strength of the green body or the insulator for a spark plug is secured, and breakage or the like is less likely in the green body or the insulator for a spark plug.

According to the manufacturing method of the first aspect, high yield can be secured even if the diameter of the insulator is made small.

The unnecessary portion, where the first position is located, may be any portion of the green body if to be removed in the process for removing the unnecessary portion which is a post step. For example, the unnecessary portion may be located on the leading-end side or base-end side of the green body with respect to a green body of which the unnecessary portion corresponding to the external shape of the insulator for a spark plug is removed. When the processing of increasing the diameter of a through hole formed by the existence of the press pin is performed in the process for removing the unnecessary portion, the unnecessary portions can be a part or all of an inner wall of the through hole removed by the processing.

In the manufacturing method of the first aspect, the external diameter of the pin-side spiral portion of the press pin may be smaller than an external diameter of an outer peripheral surface of a portion that is closer to the base end than the pin-side spiral portion, and the first position may be set such that the green body-side spiral portion is located in an unnecessary portion on a leading end side of the green body.

In this case, the external diameter of the pin-side spiral portion is made smaller than the external diameter of the outer peripheral surface of a portion that is closer to the base end than the pin-side spiral portion of the press pin. For this reason, when the first position is set such that the green body-side spiral portion is located in the unnecessary portion on the leading end side of the green body, the pin-side spiral portion of the press pin does not interfere with an inner circumferential surface of the green body even after it (the pin-side spiral portion) slips out of the green body-side spiral portion. Accordingly, in this manufacturing method, the press pin can be extracted from the green body without deforming and damaging the green body if the press pin is withdrawn with respect to the green body while being rotated relative to the green body around an axis in the process for removing the press pin. As a result, this manufacturing method can reliably exhibit the effects of the first aspect.

In addition, if the process, for removing unnecessary portion and a process for finishing the green body to an external shape corresponding to the insulator for a spark plug are simultaneously performed, complications in the manufacturing step can be reduced.

Additionally, if an end face forming portion capable of forming a base end face of the green body to the shape of a flange is provided on the base end side of the press pin, when the external shape is finished by inserting a supporting pin which supports the green body from the base end of the green body in the process for finishing the green body to an external shape, it is not necessary to form the base end face of the green body again, and it is also not necessary to insert the supporting pin again. This is advantageous since working man-hours can be reduced.

According to a second aspect of the invention, there is provided a method for manufacturing an insulator for a spark plug which has a through hole extending in an axial direction for receiving a center electrode and a terminal electrode, which insulators comprise a thick-walled portion having a wall thickness defined between the through hole and an outer peripheral surface that is greater than those of other portions in the axial direction, said method comprising: preparing a press pin for forming the through hole and a forming die having a cavity, the press pin comprising a rib-shaped pin-side spiral portion formed on an outer peripheral surface of a second position of the press pin; filling a raw powder into the cavity; arranging the press pin within the cavity by advancing a leading end of the press pin in the axial direction before, during, or after filling the powder; pressing the raw powder within the cavity along with the press pin, and obtaining a green body formed with a green body-side spiral portion to which a shape of the pin-side spiral portion is transferred, after arranging the press pin; releasing the green body along with the press pin from the cavity, after forming the green body; and withdrawing the press pin with respect to the green body while rotating the press pin relative to the green body around an axis, and extracting the press pin from the green body, after releasing the die, wherein an outer diameter of the pin-side spiral portion is smaller than an outer diameter of an outer peripheral surface of a portion that is closer to a base end than the pin-side spiral portion, and wherein the second position is positioned such that the green body-side spiral portion is located within the thick-walled portion.

In the manufacturing method of the second aspect, the second position in the press pin, where the pin-side spiral portion is formed, is set such that the green body-side spiral portion is located in the thick-walled portion of the green body. For this reason, the green body-side spiral portion remains within the thick-walled portion. However, since the thick-walled portion is a portion where the wall thickness between the through hole and an outer peripheral surface is greater than other portions in axial direction, deterioration of strength is not caused in the green body even if the green body-side spiral portion remains. Consequently, the strength of the green body or the insulator for a spark plug is maintained, and breakage or the like is less likely in the green body or the insulator for a spark plug.

In this manufacturing method, the external diameter of the pin-side spiral portion is made smaller than the external diameter of an outer peripheral surface of a portion of the press pin that is closer to the base end than the pin-side spiral portion of the press pin. For this reason, the pin-side spiral portion does not interfere with the inner circumferential surface of the green body even after it slips out of the green body-side spiral portion. Consequently, the press pin can be extracted from the green body without deforming and damaging the green body by withdrawing the press pin with respect to the green body while the press pin is rotated relative to the green body around an axis in the process for the press pin.

According to the manufacturing method of the second aspect, high yield can be secured even if the diameter of the insulator is made small.

In the second aspect of the invention, the second position may be positioned such that a resistor provided between the center electrode and the terminal electrode does not contact the green body-side spiral portion.

If the second position is set such that a resistor provided between the center electrode and the terminal electrode contacts the green body-side spiral portion in the manufacturing method of the second aspect, when the resistor is inserted into the through hole of the insulator for a spark plug by hot pressing or the like, spiral ribs are formed at an outer peripheral surface of the resistor under the influence of the green body-side spiral portion. For this reason, it becomes difficult to make the resistor exhibit intended performance, which may increase the error of the resistance value of the resistor.

In contrast, if the second position is set such that a resistor provided between the center electrode and the terminal electrode does not contact the green body-side spiral portion, even when the resistor is inserted into the through hole of the insulator for a spark plug by hot pressing or the like, the resistor is formed in an cylindrical shape without being influenced by the green body-side spiral portion. Accordingly, this manufacturing method can make the resistor reliably exhibit predetermined performance.

In the manufacturing method of the first and second aspects, the process for arranging the press pin within the cavity by advancing the leading end of the press pin in the axial direction can be performed before, during, or after the powder filling step.

According to a third aspect of the invention, there is provided a method for manufacturing a spark plug of the aspect comprising manufacturing an insulator by the above-described method for manufacturing the insulator for the spark plug, and assembling the insulator and other constituent members together. Since the spark plug obtained from this manufacturing method can exhibit the effects of the method for manufacturing an insulator for a spark plug of the above-described aspects, it is possible to secure high yield, and it is possible to realize low manufacturing cost.

DETAILED DESCRIPTION OF EXEMPLARY EMBODIMENTS OF THE INVENTION

Figure 1:
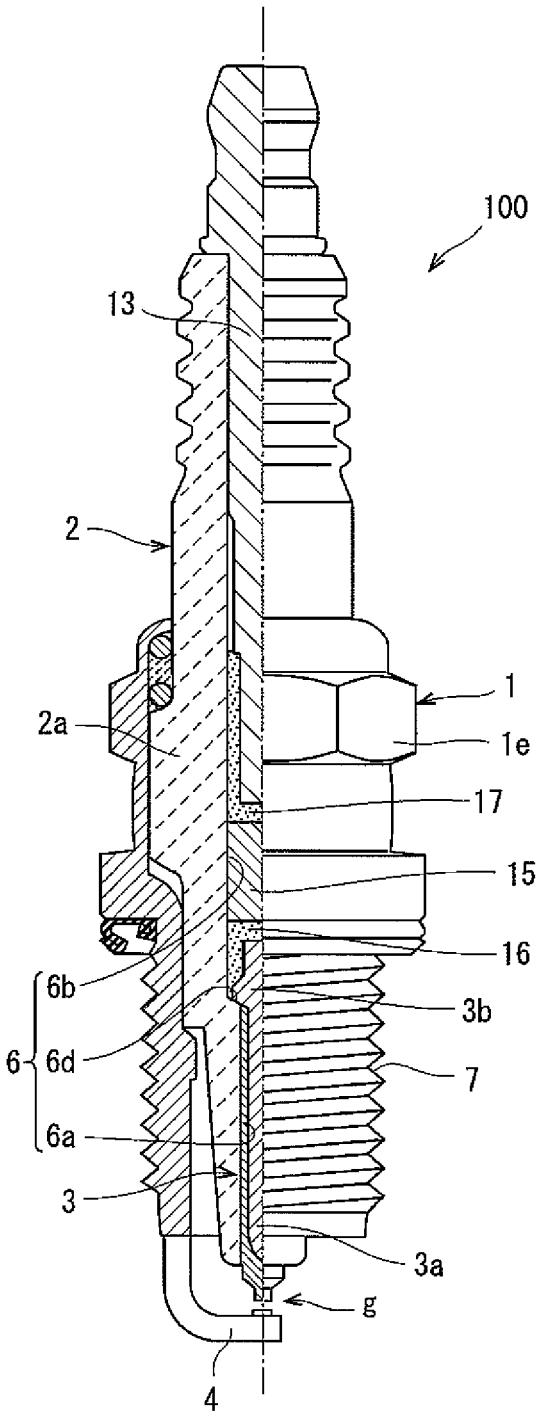
FIG. 1 is a front view (partially sectional view) of a spark plug in which an insulator is applied, in a method for manufacturing an insulator for a spark plug of Embodiment 1.

Hereinafter, exemplary Embodiments 1 to 3 of the present invention will be described with reference to the drawings. In the drawings, a vertical direction is defined as an axial direction, the lower side is defined as the leading end side of a spark plug 100, press pins 50, 350, and 250, and insulators 2 and 202 for a spark plug, and the upper side is defined as the base end side of the spark plug 100, the press pins 50, 350, and 250, and the insulators 2 and 202 for a spark plug.

Embodiment 1

A manufacturing method of Embodiment 1, as shown in FIG. 1, is a method of manufacturing the insulator 2 which is an exemplary illustrative aspect of an insulator for a spark plug. Since the insulator 2 is an element of the spark plug 100, first, the entire configuration of the spark plug 100 will be described.

The spark plug 100 includes a cylindrical metal shell 1. An insulator 2 is fitted into the metal shell 1 such that a leading end of the insulator 2 protrudes from the metal shell 1. A center electrode 3 is provided inside the insulator 2 in a state where a leading end of the center electrode 3 protrudes from the insulator 2. A ground electrode 4 is arranged such that one end is joined to the metal shell 1 by welding or the like, and the other end bent in a lateral direction and a side surface of the other end opposes a leading end portion of the center electrode 3.

A spark discharge gap "g" is formed between the ground electrode 4 and the center electrode 3. The metal shell 1 has a cylindrical shape and contains metal, such as low-carbon steel. The metal shell 1 defines a housing of the spark plug 100, and its outer peripheral surface is formed with a thread portion 7 and a tool engaging portion 1*e*. The thread portion 7 is provided to attach the plug 100 to an engine block (not shown). The tool engaging portion 1*e* has a hexagonal axial cross-sectional shape, and is engaged with a tool, such as a spanner or a wrench, when the metal shell 1 is attached. Additionally, the center electrode 3 and the ground electrode 4 are made of an Ni alloy or the like. A core material 3*a*, such as Cu or a Cu alloy for promotion of heat radiation, may be buried in the center electrode 3 as needed.

The insulator 2 is made of an insulating material which includes mainly alumina or the like. A through hole 6 for inserting the center electrode 3 and the terminal electrode 13 is formed in an axial direction. A thick-walled portion 2*a*, where the wall thickness between the through hole 6 and an outer peripheral surface is greater than other portions in the axial direction, is formed almost in the middle of the insulator 2 in the axial direction. The thick-walled portion 2*a* is adapted to fit into an inner circumferential surface of the metal shell 1.

The center electrode 3 is inserted into and fixed to the through hole 6 on the leading end side thereof, and the terminal electrode 13 is inserted into and fixed to the through hole 6 on the base end side thereof. Additionally, a resistor 15 is arranged between the terminal electrode 13 and the center electrode 3 within the through hole 6. Both ends of the resistor 15 are electrically connected to the center electrode 3 and the terminal electrode 13, respectively, via conductive glass seal layers 16 and 17. In addition, the resistor 15 is formed from a resistor composition obtained by mixing glass powder and conductive material powder (and if required, ceramic powders other than glass) and sintering the resulting mixture by a hot press or the like.

The diameter of an axial cross-section of the center electrode 3 is set to be smaller than the diameter of an axial cross-section of the resistor 15. Also, the through hole 6 has a substantially cylindrical first portion 6*a* which allows the center electrode 3 to be inserted therethrough, and a substantially cylindrical second portion 6*b* which is formed with a larger diameter than the first portion 6*a* on the base side (on the upper side in the drawing) of the first portion. The terminal electrode 13 and the resistor 15 are accommodated within the second portion 6*b*, and the center electrode 3 is inserted into the first portion 6*a*. A base end of the center electrode 3 is formed with an electrode-fixing convex portion 3*b* which protrudes outward from an outer peripheral surface thereof. A convex-receiving surface 6*d* for receiving the electrode-fixing convex portion 3*b* of the center electrode 3 is formed in the form of a tapered surface or a rounded surface in a connecting position between the first portion 6*a* and the second portion 6*b* of the through hole 6.

In order to make it easy to extract the press pin 50 which will be described later, an extraction taper (for example, about 5/1000 to 5/100) which has a larger diameter toward the base side in the axial direction is given to an inner peripheral surface of the second portion 6*b* of the through hole 6. On the other hand, an extraction taper with a smaller angle than the second portion 6*b* is given to an inner peripheral surface of the first portion 6*a*, or an extraction taper is not substantially given to the inner peripheral surface.

In addition, if specific dimensions of an external shape of the insulator 2 are exemplified, the entire length of the insulator 2 is, for example, 30 to 75 mm, the mean inner diameter of the second portion 6*b* of the through hole 6 is about 2 to 5 mm, and the mean inner diameter of the first portion 6*a* is, for example, about 1 to 3.5 mm. In order to save the space for the spark plug 100 or improve the performance thereof, such as a heat generation characteristic, the diameter of the insulator 2 may be made smaller.

Next, a method for manufacturing the insulator 2 will be described. The above-mentioned insulator 2 is manufactured by carrying out a preparing step, a powder filling step, a press pin arranging step, a pressing and forming step, a die releasing step, a press pin removing step, and an unnecessary portion removing step in this order. Hereinafter, the respective steps will be described.

Preparing Step

In the preparing step, the press pin 50 and a forming die 80 are prepared.

Figure 2:
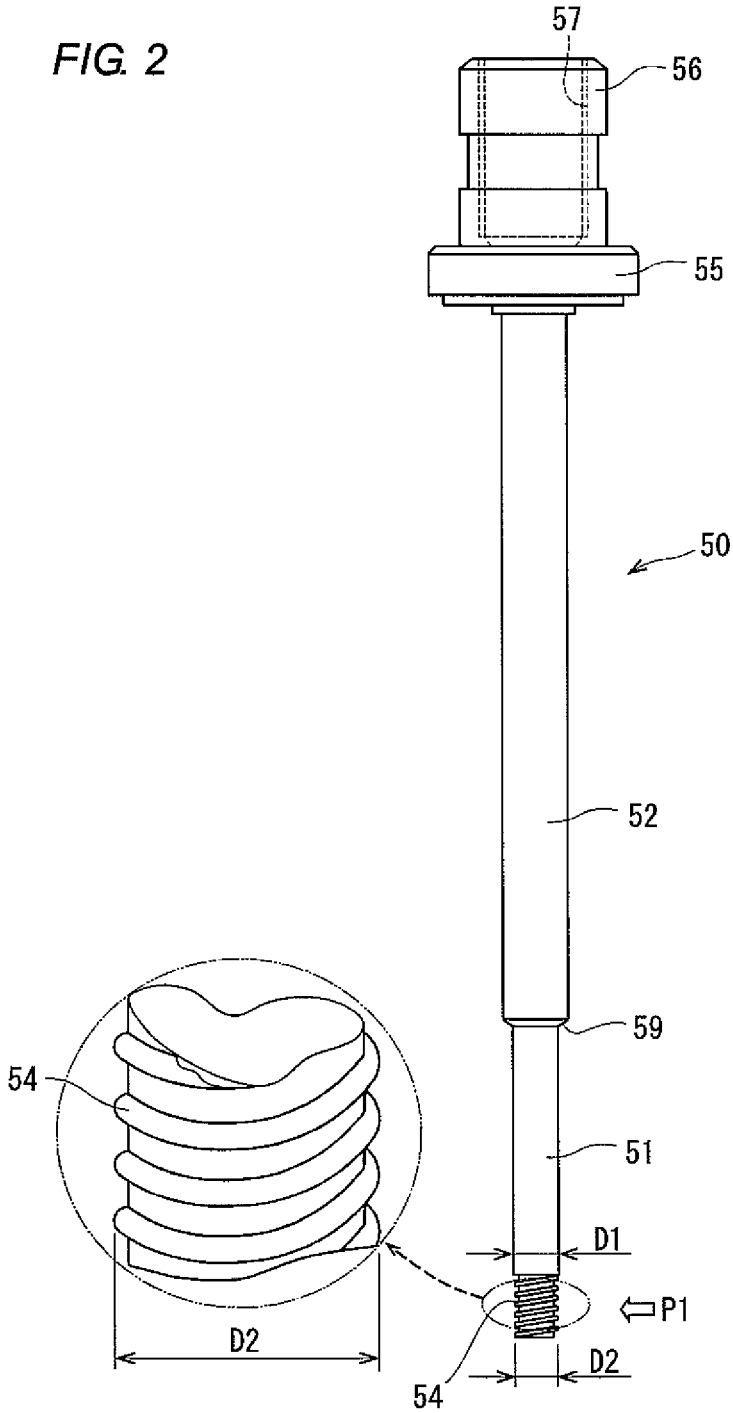
FIG. 2 is a front view of a press pin in the method for manufacturing an insulator for a spark plug of Embodiment 1.

The press pin 50, as shown in FIG. 2, is a metallic shaft body used in order to form the through hole 6. In more detail, the press pin 50 is formed with a first shaft portion 51 for forming the first portion 6*a* of the through hole 6 of FIG. 1 on the leading end side. A second shaft portion 52 is provided for forming the second portion 6*b* of the through hole 6 in a continuous form on the base side of the first shaft portion 51. Additionally, a stepped portion 59 corresponding to the convex-receiving surface 6*d* of the through hole 6 of FIG. 1 is formed between the first shaft portion 51 and the second shaft portion 52. Moreover, the press pin 50 is formed with a pin-side spiral portion 54 (which will be described later in detail) which protrudes toward the leading end side from the first shaft portion 51. In addition, a position in the press pin 50 where the pin-side spiral portion 54 is formed is referred to as a "first position P1" (shown in FIG. 2). Description of the first position P1 will be given in an unnecessary portion removing step which will be described later.

An extraction taper (for example, about 5/1000 to 5/100 corresponding to the extraction taper of the second portion 6*b*) which has a larger diameter toward the base side in the axial direction is given to an outer peripheral surface of the second shaft portion 52. On the other hand, an extraction taper (corresponding to the extraction taper of the first portion 6*a*) with a smaller angle than the second shaft portion 52 is given to an outer peripheral surface of the first shaft portion 51, or an extraction taper is not substantially given to the outer peripheral surface. In addition, the mean outer diameter of the first shaft portion 51 is set corresponding to the mean inner diameter of the first portion 6*a*. The mean outer diameter of the second shaft portion 52 is set corresponding to the mean inner diameter of the second portion 6*b* of the through hole 6.

Since the press pin 50 is a very thin shaft body in this way, for example, the whole press pin is made of a material of high rigidity, such as by way of example and not limitation, cemented carbide, alloy tool steel, etc. so that problems, such as bending, are not caused, for example, in a pressing and forming step or the like. Additionally, in order to make it easy to extract the press pin 50 from the through hole 6, the surface of the first shaft portion 51 or the second shaft portion 52 is formed with a die-releasing layer, such as by way of example and not limitation, a hard-carbon-based die-releasing film.

Figure 4:
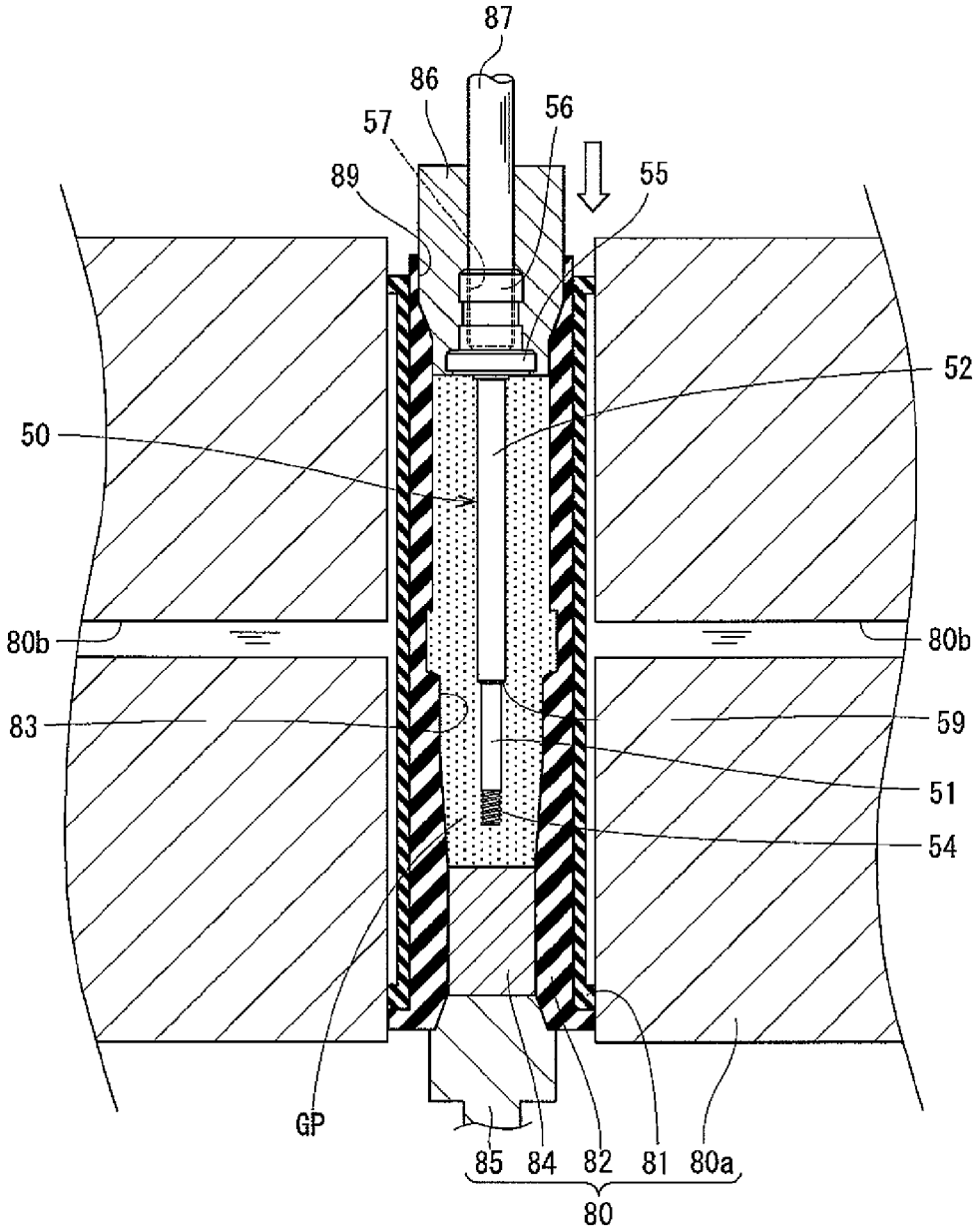
FIG. 4 is an explanatory view showing a step of manufacturing an insulator in the method for manufacturing an insulator for a spark plug of Embodiment 1.

A flange-shaped end face forming portion 55 which forms a base end face of a green body PC1, which will be described in greater detail later, is integrally formed at a base end of the second shaft portion 52 of the press pin 50. A head 56 in which a female thread portion 57 is formed is integrally formed in the axial direction further on the base side of the forming portion. As shown in FIG. 4, an upper holder portion 86 is rotatably fitted to the outside of the head 56.

As shown in FIG. 2, ribs are provided at a cylindrical outer peripheral surface of the pin-side spiral portion 54 so as to protrude spirally. The external diameter D2 of the pin-side spiral portion 54 is made smaller than the external diameter D1 (external diameter on the leading end side of the first shaft portion when an extraction taper is given to the first shaft portion 51) of the outer peripheral surface of the first shaft portion 51 that is closer to the base end than the pin-side spiral portion 54. In addition, the spiral winding direction of the pin-side spiral portion 54 is reverse to the spiral winding direction of the female thread portion 57.

The forming die 80, as shown in FIGS. 3 to 6, is an apparatus which performs a forming method that is generally called "rubber pressing." The "rubber pressing" is a forming method of filling powder, such as a ceramic material, into a rubber die, applying high fluid pressure from an outer periphery of the rubber die, and manufacturing a homogeneous green body.

In more detail, the forming die 80 is configured such that a cylindrical inner rubber die 82 has a cavity 83 passing therethrough in an axial direction. The inner rubber die 82 is substantially concentrically arranged within a cylindrical outer rubber die 81 that in turn is arranged within a forming die body 80*a*. A lower opening of the cavity 83 is closed by a bottom lid 84 and a lower holder portion 85. On the other hand, an opening 89 is formed above the cavity 83. The opening 89, as shown in FIG. 4, is closed when a base end of the press pin 50, with which the upper holder portion 86 is integrated, is fitted into the opening during a press pin arranging step, which will be described later. As a result, the inside of the cavity 83 is brought into a sealed state.

Powder Filling Step

Figure 3:
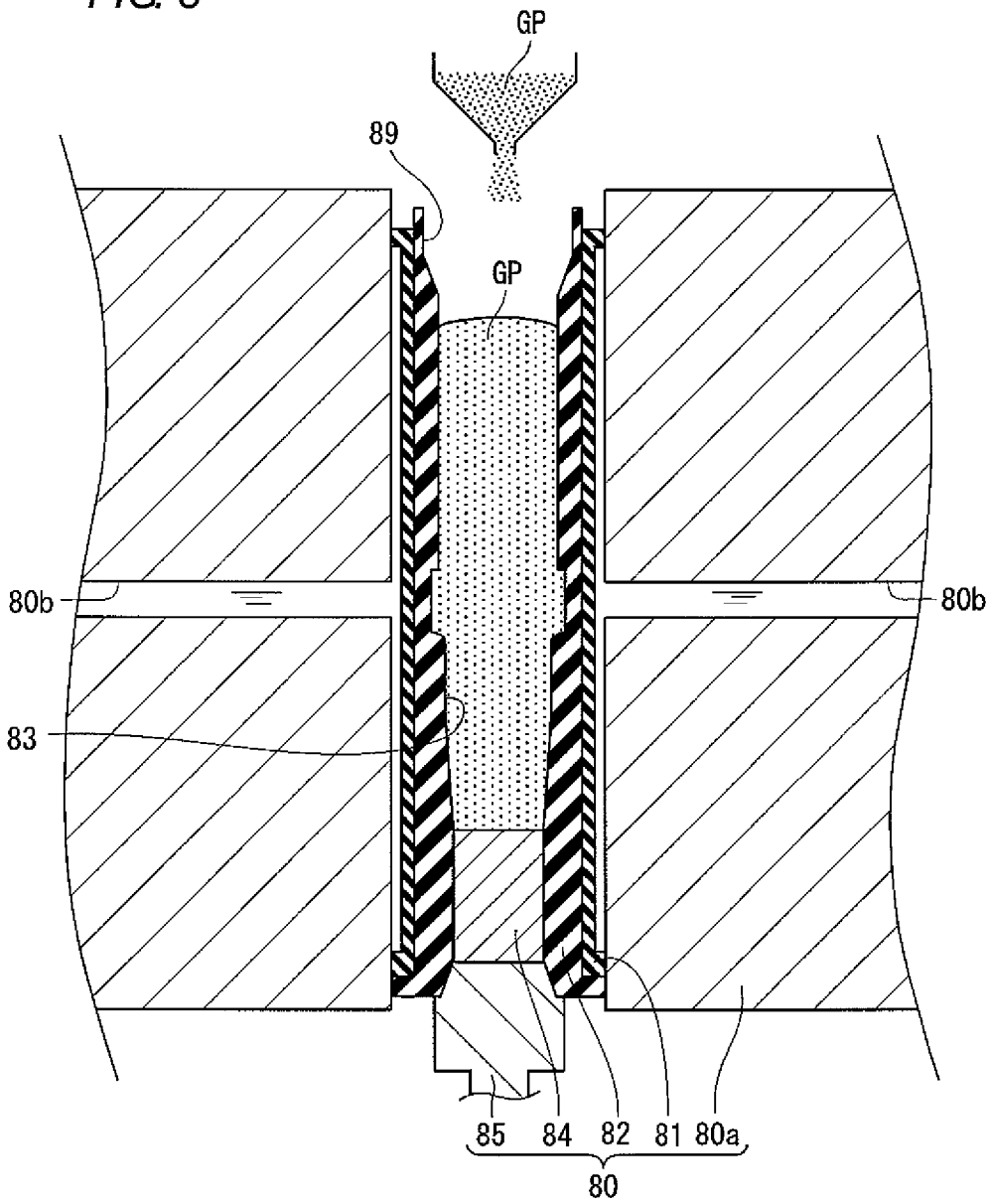
FIG. 3 is an explanatory view showing a step of manufacturing an insulator in the method for manufacturing an insulator for a spark plug of Embodiment 1.

In the powder filling step, as shown in FIG. 3, raw powder GP is put and filled into the cavity 83 through the opening 89 of the cavity 83.

Here, specifically, the raw powder GP is prepared as follows. First, a base slurry for forming is made by blending alumina powder (whose mean particle diameter is 1 to 5 μm) with an additive-element-based raw material, such as an Si component, a Ca component, an Mg component, a Ba component, or a B component which is used as a sintering agent, in a predetermined ratio, and adding and mixing a hydrophilic binder (for example, PVA or an acrylamide-based binder) and water. In addition, as for the respective additive-element-based raw materials, for example, the Si component can be blended in the form of an $SiO_2$ powder, the Ca component can be blended in the form of a $CaCO_3$ powder, the Mg component can be blended in the form of an MgO powder, the Ba component can be blended in the form of a $BaCO_3$ powder, the B component can be blended in the form of an $H_3BO_3$ powder (or may be an aqueous solution). Also, the raw powder GP as a granulated basis material for forming is manufactured by spraying and drying the base slurry for forming by a spraying and drying method or the like.

The raw powder GP manufactured in this way is adjusted so as to contain moisture within a range of 1.5 or less percentage by weight by adjustment of conditions at the time of spraying and drying (for example, drying temperature, spraying velocity, etc.). Main objects of the moisture blending are to loosen the binding force of powder particles in granulated particles, to promote cracking of the granulated particles applied at the time of pressing, and to swell a hydrophilic binder blended with the base material so as to effectively obtain a caking property of the raw powder GP and to enhance the strength of the green body PC1.

Although the lower limit of the moisture content of the raw powder GP differs according to the particle size distribution of the raw powder GP, the lower limit is suitably set to such a degree that the above effect is not insufficient. In addition, if the water content exceeds 1.5% by weight, the fluidity of the granulated material may degrade, and handling may become difficult. More desirably, this water content is adjusted to a range of 1.3 or less percentage by weight.

Additionally, the blending amount of the hydrophilic binder in the raw powder GP may be adjusted to 0.5% to 3.0% by weight. If the blending amount of the hydrophilic binder becomes less than 0.5% by weight, the strength of the green body PC1 may become insufficient, handling may become difficult, and cracking, chipping, etc. may be apt to occur. Additionally, if the blending amount exceeds 3.0% by weight, de-binder treatment time at the time of sintering becomes long, which leads to lowering of the manufacturing efficiency of an insulator. In addition to this, the residual volume of impurities components (for example, carbon) originating from a binder in the insulator may increase, which leads to deterioration performance (for example, insulating voltage resistance).

As shown in FIG. 3, the raw powder GP adjusted in the above state is put into the cavity 83 through the opening 89, and is deposited upward from below. Once a predetermined amount of raw powder GP is filled into the cavity 83, shifting to the next step is performed.

Press Pin Arranging Step

In the press pin arranging step, as shown in FIG. 4, a leading end of a rotary shaft 87 is screwed into the female thread portion 57, and the press pin 50, in a state where the upper holder portion 86 is fitted to the outside of the head 56, is arranged within the cavity 83 by advancing its leading end in the axial direction. In this case, the opening 89 is plugged by fitting the base end of the press pin 50, with which the upper holder portion 86 is integrated, into the opening 89, thereby bringing the cavity 83 into a sealed state.

Pressing and Forming Step

Figure 5:
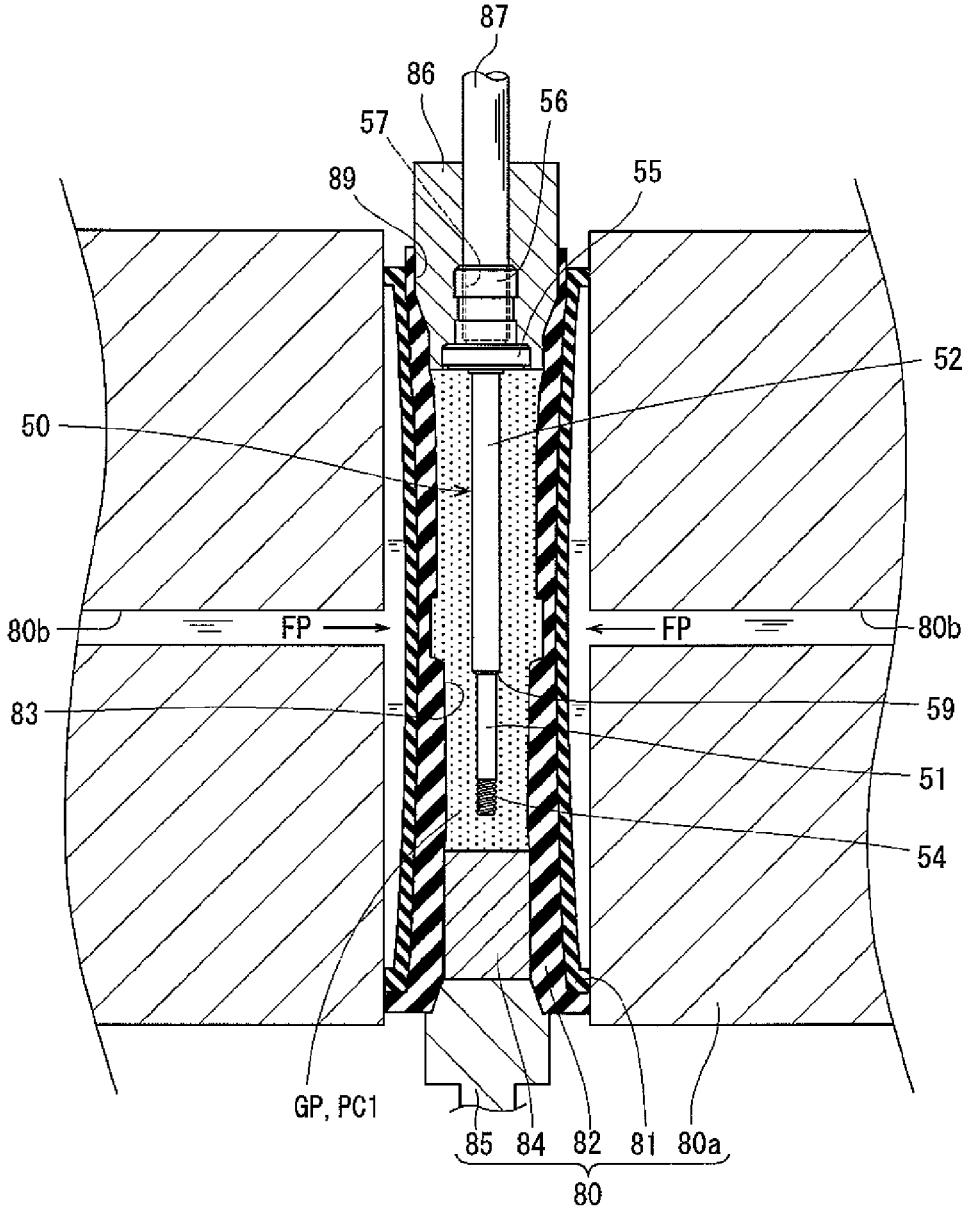
FIG. 5 is an explanatory view showing a step of manufacturing an insulator in the method for manufacturing an insulator for a spark plug of Embodiment 1.

In the pressing and forming step, as shown in FIG. 5, the raw powder GP within the cavity 83 is pressed along with the press pin 50 to obtain the green body PC1.

In more detail, fluid pressure FP is applied on the outer peripheral surface of the outer rubber die 81 in the radial direction via a pressurized liquid passage 80*b* formed in the forming die body 80*a*. Then, the outer rubber die 81 and the inner rubber die 82 elastically deform such that their diameters are reduced, and the cavity 83 also shrinks. For this reason, the raw powder GP that fills the cavity 83 is pressed and compressed as the fluid pressure FP is indirectly applied thereto via the outer rubber die 81 and the inner rubber die 82. As a result, the raw powder GP of the cavity 83 is solidified in such a form that the press pin 50 is integrated therewith, and the green body PC1 is obtained.

In this case, the fluid pressure FP may be adjusted in a range of 30 to 100 MPa. If the fluid pressure FP becomes less than 30 MPa, the strength of the green body PC1 may become insufficient, handling may become difficult, and cracking, chipping, etc. may be apt to occur. On the other hand, if the fluid pressure exceeds 100 MPa, the lifespan of the outer rubber die 81 and the inner rubber die 82 may become short, which may lead to an increase in cost. Additionally, by such high-pressure forming, a part of an inner wall portion of the cavity 83 may be pressed into a space among powder particles of an outer surface of the green body PC1 and nipped by the powder particles. For this reason, in the die releasing step, when application of the fluid pressure FP is released, the smooth elastic restoration of the inner rubber die 82 is easily hindered. As a result, vibration by the rapid elastic restoration of the inner rubber die 82 may be easily generated, and the green body PC1 may be easily damaged.

Die Releasing Step

Figure 6:
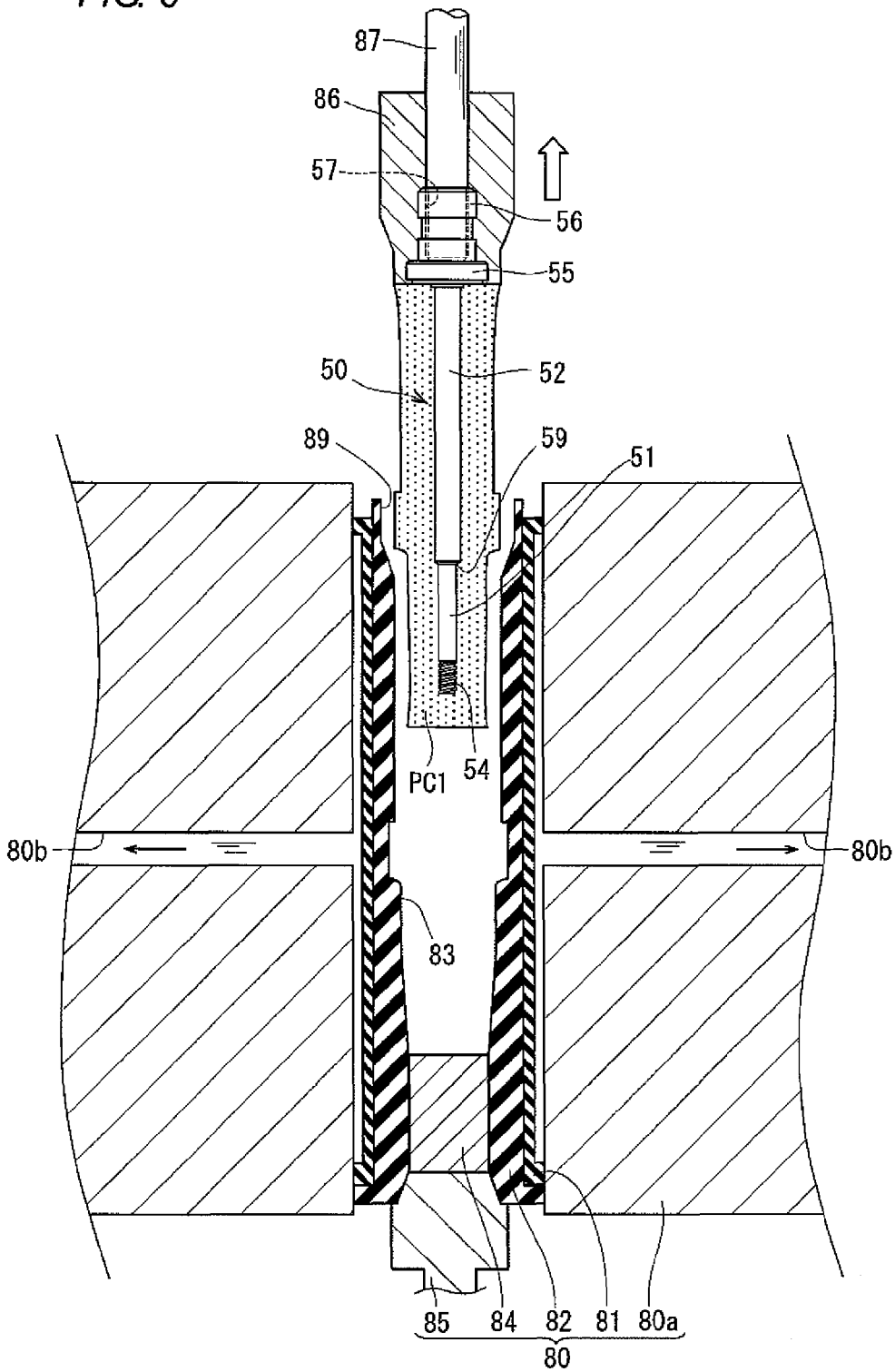
FIG. 6 is an explanatory view showing a step of manufacturing an insulator in the method for manufacturing an insulator for a spark plug of Embodiment 1.

In the die releasing step, as shown in FIG. 6, the green body PC1 along with the press pin 50 is released from the cavity 83. In more detail, when application of the fluid pressure FP is released, the outer rubber die 81 and the inner rubber die 82 make elastic restoration, and return to their original shapes, and the cavity 83 which has shrunk also return to its original shape. Accordingly, an outer peripheral surface of the green body PC1 which has been compressed and formed and an inner peripheral surface of the cavity 83 are separated from each other, thereby forming a space therebetween. By pulling up the press pin 50 integrated with the rotary shaft 87 and the upper holder portion 86 toward the base end in the axial direction with respect to the outer rubber die 81 and the inner rubber die 82, the press pin 50 is drawn out from the cavity 83 in a state where the green body PC1 has stuck thereon.

Press Pin Removing Step

Figure 7:
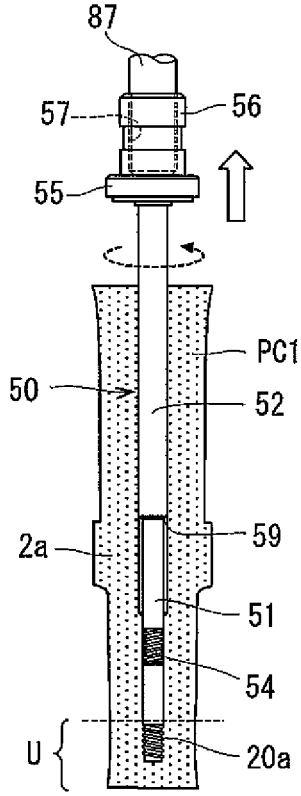
FIG. 7 is an explanatory view showing a step of manufacturing an insulator in the method for manufacturing an insulator for a spark plug of Embodiment 1.

In the press pin removing step, as shown in FIG. 7, the press pin 50 is pulled out from the green body PC1. In more detail, when the forming step is performed using the press pin 50 in which the pin-side spiral portion 54 is formed, a green body-side spiral portion 20*a* of a shape (that is, a groove shape) obtained by reversing the pin-side spiral portion 54 is formed at a front end of an inner circumferential surface of the green body PC1 which opposes the pin-side spiral portion 54.

Also, as shown in FIG. 7, with the green body PC1 pulled up from the cavity 83 and held by an air chunk (not shown), the rotary shaft 87 which is threadedly mounted on a female thread hole 57 of the press pin 50 is rotated in a direction in which it is fastened into the female thread hole 57 by a driving source, such as a motor which is not shown. Then, the press pin 50 rotates around an axis with respect to the green body PC1, and the press pin 50 threadedly advances and moves up in the extraction direction, on the basis of the screw operation by the engagement between pin-side spiral portion 54 and the green body-side spiral portion 20*a*.

That is, since the press pin 50 moves up slowly by the threadedly advancing operation of the thread while it rotates, an excessive frictional force is hardly generated between the press pin 50 and the inner circumferential surface of the green body PC1 which opposes the outer peripheral surface of the press pin 50, and as a result, the press pin 50 can be extracted smoothly without damaging the green body PC1.

Additionally, since the external diameter D2 of the pin-side spiral portion 54 is smaller than the external diameter D1 of the outer peripheral surface of the first shaft portion 51 that is closer to the base end than the pin-side spiral portion 54, the pin-side spiral portion 54 does not interfere with the inner circumferential surface of the green body PC1 even after it slips out of the green body-side spiral portion 20*a*. For this reason, the press pin 50 can be extracted without deforming and damaging the green body PC1.

Moreover, since an extraction taper is given to at least the second shaft portion 52 of the press pin 50, a gap from the inner circumferential surface of the green body PC1 can be obtained, and the press pin 50 can be released easily, only by raising the press pin 50 slightly. If a die-releasing layer, such as a hard-carbon-based die releasing film, is formed at the outer peripheral surface of the press pin 50, it is natural that extraction of the press pin 50 becomes easier.

Unnecessary Portion Removing Step

Figure 8:
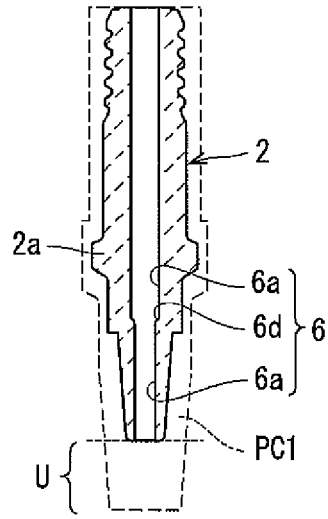
FIG. 8 is an explanatory view showing a step of manufacturing an insulator in the method for manufacturing an insulator for a spark plug of Embodiment 1.

In the unnecessary portion removing step, as shown in FIGS. 7 and 8, an unnecessary portion U is removed from the green body PC1. In Embodiment 1, the unnecessary portion U is defined as a portion closer to the leading end than a broken line on the leading end side of the green body PC1 and including the green body-side spiral portion 20*a*. In addition, in this embodiment, the green body-side spiral portion 20*a* is included in the unnecessary portion U by extending the green body PC1 toward the leading end side, compared with a related-art one. Also, when the unnecessary portion U is removed by a cutting tool, such as a grinder, the green body-side spiral portion 20*a* does not remain at the inner circumferential surface of the green body PC1 unlike the related-art manufacturing method. As such, the first position P1, i.e., the position in the press pin 50 where the pin-side spiral portion 54 is formed, is set such that the green body-side spiral portion 20*a* is located in the unnecessary portion U on the leading end side of the green body PC1.

The green body PC1 which has completed the above respective steps and from which the press pin 50 has been extracted, as shown in FIG. 8, has an outer surface machined by grinder cutting or the like. The green body PC1 is finished to an external shape corresponding to the insulator 2, and is then sintered at a temperature of 1400 to 1650° C. Accordingly, the inner circumferential surface of the green body PC1 which has opposed the outer peripheral surface of the press pin 50 becomes the through hole 6. Then, the green body is further finished and sintered by applying glaze thereto, whereby the insulator 2 is completed. The spark plug 100 using the insulator 2 obtained in this way is attached to an engine block at the thread portion 7 thereof, and is used as an igniting source for an air-fuel mixture to be supplied to a combustion chamber.

Here, in the method for manufacturing the insulator 2 of Embodiment 1, the first position P1 is set such that the green body-side spiral portion 20*a* is located in the unnecessary portion U on the leading end side of the green body PC1. For this reason, in this manufacturing method, the green body-side spiral portion 20*a* does not remain as part of the green body PC1 after the unnecessary portion U has been removed. For this reason, the wall thickness of the green body PC1 does not become small as a result of the green body-side spiral portion 20*a*. For this reason, the strength of the green body PC1 or the insulator 2 is secured, and breakage or the like is less likely in the green body PC1 or the insulator 2.

Additionally, in this manufacturing method, the external diameter D2 of the pin-side spiral portion 54 is made smaller than the external diameter D1 of the outer peripheral surface of the first shaft portion 51 that is closer to the base end than the pin-side spiral portion 54. For this reason, in the press pin removing step, the pin-side spiral portion 54 does not interfere with the inner circumferential surface of the green body PC1. For this reason, in this manufacturing method, the press pin 50 can be extracted from the green body PC1 without deforming and damaging the green body PC1.

According to the manufacturing method of the insulator 2 of Embodiment 1, high yield can be secured even if the diameter of the insulator is made small. As for the spark plug 100 obtained by assembling the insulator 2 and other components together, high yield can be secured, and low manufacturing cost can be realized.

Embodiment 2

Figure 9:
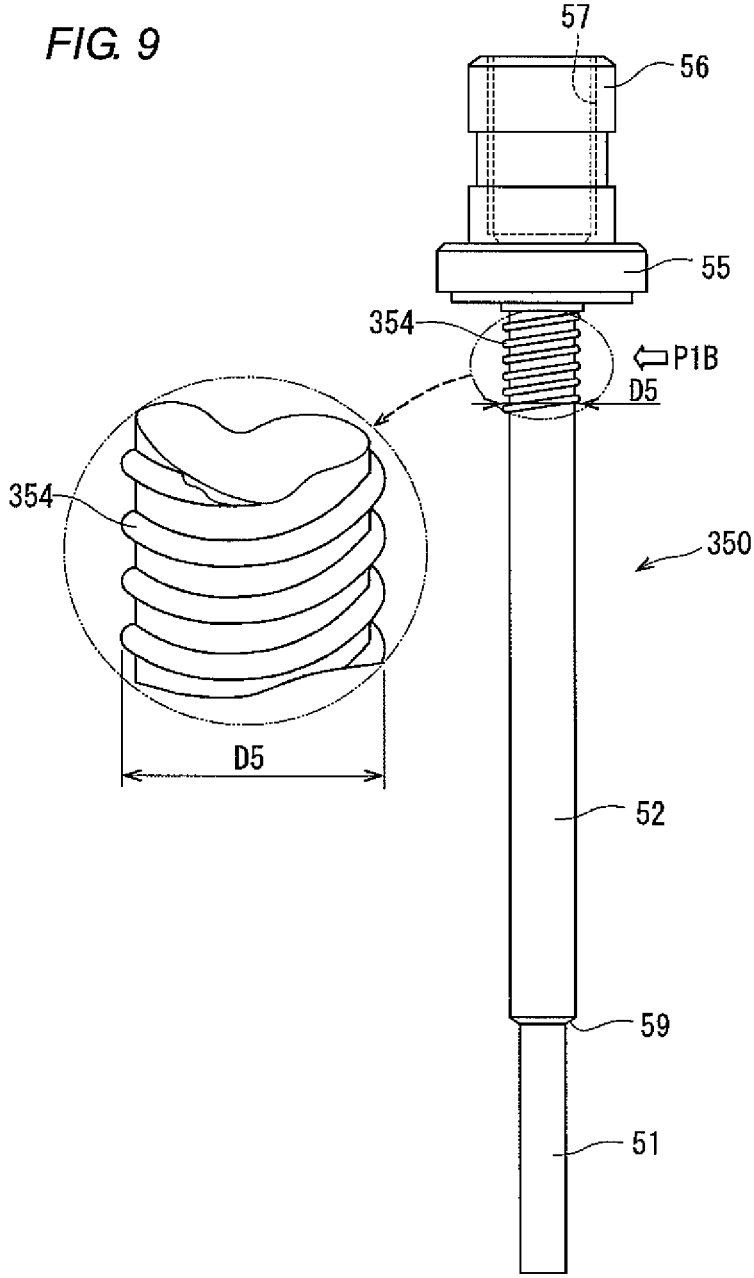
FIG. 9 is a front view of a press pin in a method for manufacturing an insulator for a spark plug of Embodiment 2.
Figure 10:
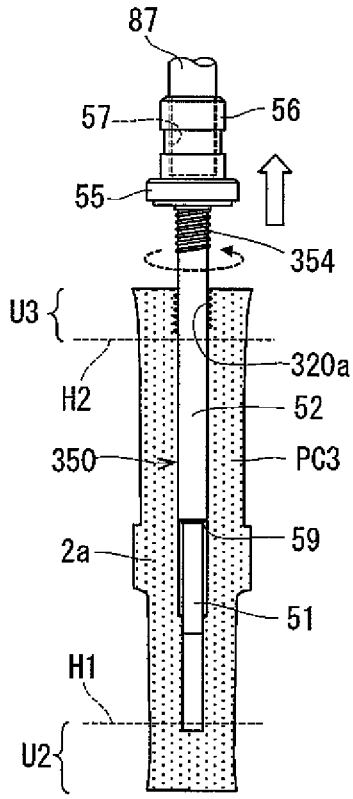
FIG. 10 is an explanatory view showing a step of manufacturing an insulator in the method for manufacturing an insulator for a spark plug of Embodiment 2.
Figure 11:
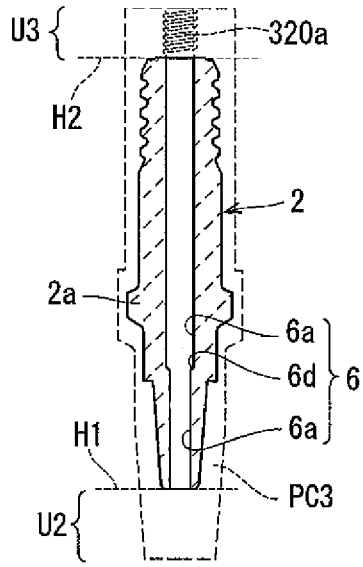
FIG. 11 is an explanatory view showing a step of manufacturing an insulator in the method for manufacturing an insulator for a spark plug of Embodiment 2.

A manufacturing method of Embodiment 2, similarly to the manufacturing method of Embodiment 1, is a method of manufacturing the insulator 2 shown in FIG. 1. In the manufacturing method of Embodiment 2, a press pin 350 shown in FIG. 9 is adopted instead of the press pin 50 according to Embodiment 1. Additionally, as shown in FIGS. 10 and 11, a green body PC3 which is different from the green body PC1 according to Embodiment 1 is obtained in the pressing and forming step, and unnecessary portions U and U3 are removed from the green body PC3 in the unnecessary portion removing step. The other configuration is the same as the manufacturing method of Embodiment 1. For this reason, the same components as those of Embodiment 1 are denoted by the same reference numerals, and the description thereof is omitted. In addition, differences from those of the manufacturing method of Embodiment 1 will be described in an emphasized manner, and the description of the same steps as the respective steps of Embodiment 1 will be omitted or simplified.

In the manufacturing method of Embodiment 2, the insulator 2 is manufactured by carrying out a preparing step, a powder filling step, a press pin arranging step, a pressing and forming step and, a die releasing step, and a press pin removing step in this order. Hereinafter, the respective steps will be described.

Preparing Step

In the preparing step, the press pin 350 and the forming die 80 are prepared. In addition, since the forming die 80 is the same as that of Embodiment 1, the description thereof is omitted.

As shown in FIG. 9, the press pin 350 is obtained by removing the pin-side spiral portion 54 which protrudes toward the leading end side from the first shaft portion 51 of the press pin 50, and instead of this pin-side spiral portion 54, forming a pin-side spiral portion 354 between the second shaft portion 52 and the end face forming portion 55 of the press pin 50. In addition, a position in the press pin 350 where the pin-side spiral portion 354 is formed is referred to as a "first position P1B" (shown in FIG. 9). Description of the first position P1B will be given in an unnecessary portion removing step which will be described later. Since other configurations of the press pin 350 are the same as those of the press pin 50 according to Embodiment 1, they are denoted by the same reference numerals, and the description thereof is omitted.

Ribs are provided at a cylindrical outer peripheral surface of the pin-side spiral portion 354 so as to protrude spirally. The external diameter D5 of the pin-side spiral portion 354 is made larger than the external diameter of the outer peripheral surface of the second shaft portion 52. In addition, the spiral winding direction of the pin-side spiral portion 354 is reverse to the spiral winding direction of the female thread portion 57.

Powder Filling Step to Die Releasing Step

Since the powder filling step to the die releasing step are the same as those of Embodiment 1, except that the press pin 50 is substituted with the press pin 350, the description thereof is omitted. When the powder filling step to the die releasing step are carried out similarly to Embodiment 1, as shown in FIG. 10, a green body PC3 which is integrated with the press pin 350 is obtained.

Press Pin Removing Step

In the press pin removing step, as shown in FIG. 10, the press pin 350 is pulled out from the green body PC3. In more detail, when forming is performed using the press pin 350 in which the pin-side spiral portion 354 is formed, a green body-side spiral portion 320*a* of a shape (that is, a groove shape) obtained by reversing the pin-side spiral portion 354 is formed at a base end of an inner circumferential surface of the green body PC3 which opposes the pin-side spiral portion 354.

Then, as shown in FIG. 10, if a rotary shaft 87 is rotated with the green body PC3 held, similarly to Embodiment 1, the press pin 350 threadedly advances and moves up in the extraction direction, on the basis of threading operation by the engagement between the pin-side spiral portion 354 and the green body-side spiral portion 320*a*. In this way, the press pin 350 can be smoothly extracted without deforming and damaging the green body PC3.

Unnecessary Portion Removing Step

In the unnecessary portion removing step, as shown in FIGS. 10 and 11, unnecessary portions U2 and U3 are removed from the green body PC3. Here, in Embodiment 2, the unnecessary portion U2 is a portion of green body PC3 that is closer to the leading end than a broken line H1 that is shown in FIGS. 10 and 11 on the leading end side of the green body PC3. Additionally, the unnecessary portion U3 is a portion closer to the base end than a broken line H2 on the base end side of the green body PC3. In addition, in this embodiment, the green body-side spiral portion 320*a* is included by extending the green body PC3 toward the base end side compared with a related-art one. Also, when the unnecessary portions U2 and U3 are removed by a cutting tool, such as a grinder, the green body-side spiral portion 320*a* does not remain at the inner circumferential surface of the green body PC3 unlike the above related-art manufacturing method. As such, the first position P1B that is a position in the press pin 350 where the pin-side spiral portion 354 is formed is set such that the green body-side spiral portion 320*a* is located in the unnecessary portion U3 on the base end side of the green body PC3.

The green body PC3 which has completed the above respective steps and from which the press pin 350 has been extracted, as shown in FIG. 11, has an outer surface machined by grinder cutting or the like, is finished to an external shape corresponding to the insulator 2, and is then sintered at a temperature of 1400 to 1650° C. Accordingly, the inner circumferential surface of the green body PC3 which has opposed the outer peripheral surface of the press pin 350 becomes the through hole 6. Then, the green body is further finished and sintered by applying glaze thereto, whereby the insulator 2 is completed. The spark plug 100 using the insulator 2 obtained in this way is, attached to an engine block at the thread portion 7 thereof, and is used as an igniting source for an air-fuel mixture to be supplied to a combustion chamber.

Here, in the method for manufacturing the insulator 2 of Embodiment 2, the first position P1B is set such that the green body-side spiral portion 320*a* is located in the unnecessary portion U3 on the base end side of the green body PC3. For this reason, in this manufacturing method, the green body-side spiral portion 320*a* does not remain as part of the green body PC3 after the unnecessary portion U3 has been removed. For this reason, the wall thickness of the green body PC3 does not become small by the green body-side spiral portion 320*a*. For this reason, the strength of the green body PC3 or the insulator 2 is secured, and breakage or the like is less likely in the green body PC3 or the insulator 2.

Accordingly, the manufacturing method of the insulator 2 of Embodiment 2 can also exhibit the same operational effects as the manufacturing method of Embodiment 1.

Embodiment 3

Figure 12:
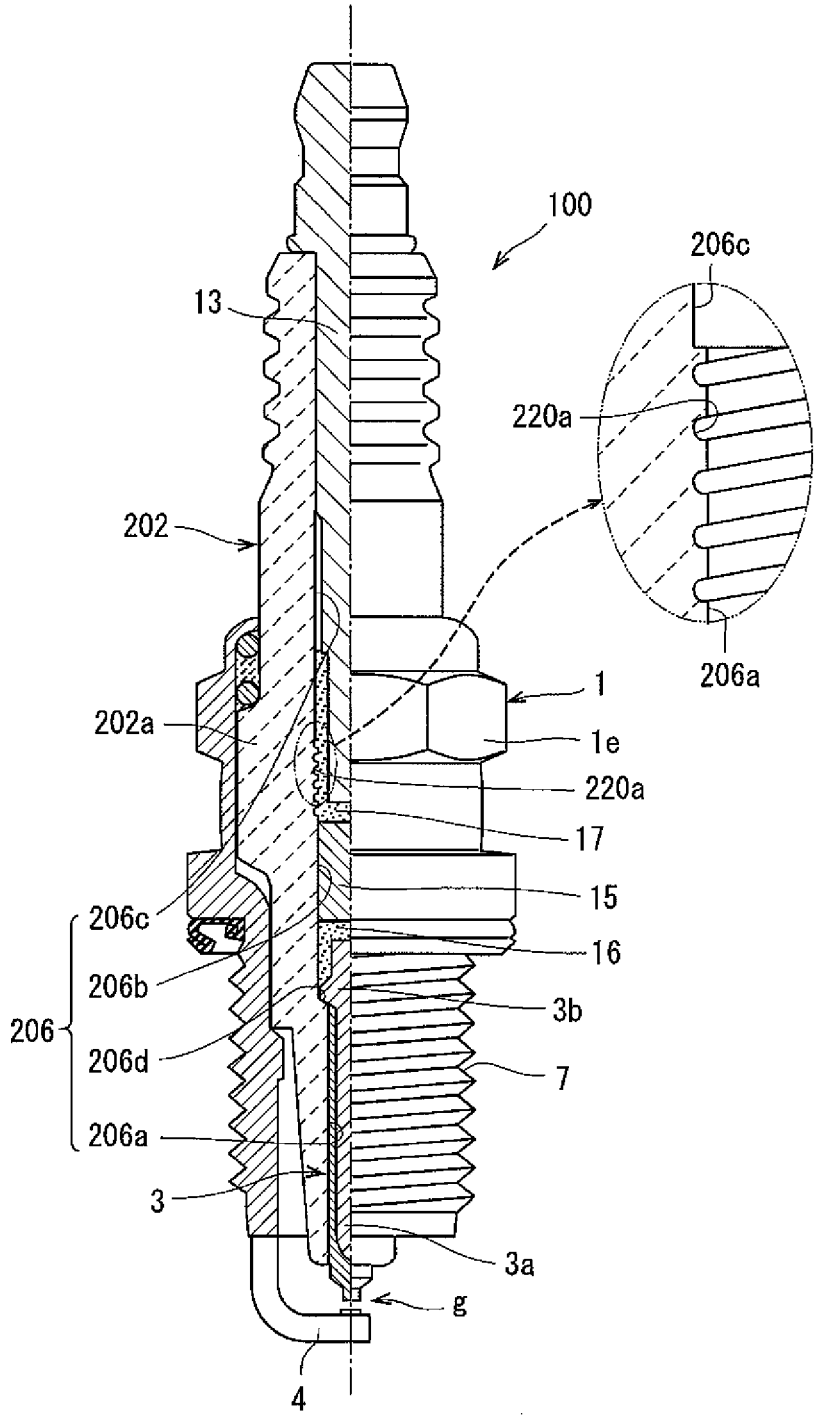
FIG. 12 is a front view (partially sectional view) of a spark plug in which an insulator is applied, in a method for manufacturing an insulator for a spark plug of Embodiment 3.

A manufacturing method of Embodiment 3, as shown in FIG. 12, is a method of manufacturing the insulator 202 which is an exemplary illustrative aspect of an insulator for a spark plug. Although an insulator 202 adopts a through hole 206 in which a green body-side spiral portion 220*a* is formed in a thick-walled portion 202*a* instead of the through hole 6 of the insulator 2 of Embodiment 1, the other configuration is the same as that of the insulator 2. The insulator body 202 also is part of a spark plug 100, similarly to the insulator 2. For this reason, the same configurations as those of Embodiment are denoted by the same reference numerals, and the description thereof is omitted. In addition, differences from those of the manufacturing method of Embodiment 1 will be described in an emphasized manner, and the description of the same steps as the respective steps of Embodiment 1 will be omitted or simplified.

As shown in FIG. 12, similarly to the insulator 2 of Embodiment 1, the insulator 202 is made of an insulating material which includes mainly alumina or the like, and a through hole 206 for inserting the center electrode 3 and the terminal electrode 13 is formed in an axial direction. A thick-walled portion 202*a* where the wall thickness between the through hole 206 and an outer peripheral surface is greater than other portions in the axial direction is formed almost in the middle of the insulator 206 in the axial direction. The thick-walled portion 202*a* is adapted to fit into an inner circumferential surface of the metal shell 1.

The center electrode 3 is inserted into and fixed to the through hole 206 on the leading end side thereof, and a terminal electrode 13 is inserted into and fixed to the through hole 206 on the base end side thereof. Additionally, the resistor 15 is arranged between the terminal electrode 13 and the center electrode 3 within the through hole 206. Both ends of the resistor 15 are electrically connected to the center electrode 3 and the terminal electrode 13, respectively, via the conductive glass seal layers 16 and 17.

The diameter of an axial cross-section of the center electrode 3 is set to be smaller than the diameter of an axial cross-section of the resistor 15. Also, the through hole 206 has a substantially cylindrical first portion 206*a* which allows the center electrode 3 to be inserted therethrough, a substantially cylindrical second portion 206*b* which is formed with a larger diameter than the first portion 206*a* on the base side (on the upper side in the drawing) of the first portion, and a substantially cylindrical third portion 206*c* which is formed with a larger diameter than the second portion 206*b* on the base side (on the upper side in the drawing) of the second portion. A green body-side spiral portion 220*a* which is obtained as a pin-side spiral portion 254 (which will be described later) is transferred thereto is formed in the shape of a spiral groove at a base end of the second portion 206*b*.

The terminal electrode 13 is accommodated within the second portion 206*b* and the third portion 206*c*, the resistor 15 is accommodated ahead of the green body-side spiral portion 220*a* within the second portion 206*b*, and the center electrode 3 is inserted into the first portion 6*a*. A base end of the center electrode 3 is formed with the electrode-fixing convex portion 3*b* which protrudes outward from an outer peripheral surface thereof. A convex-receiving surface 206*d* for receiving the electrode-fixing convex portion 3*b* of the center electrode 3 is formed in the form of a tapered surface or a rounded surface in a connecting position between the first portion 206*a* and the second portion 206*b* of the through hole 206.

In order to make it easy to extract the press pin 250 which will be described later, an extraction taper (for example, about 5/1000 to 5/100) which has a larger diameter toward the base side in the axial direction is given to inner peripheral surfaces of the second portion 206*b* and third portion 206*c* of the through hole 206. On the other hand, an extraction taper with a smaller angle than the second portion 206*b* and the third portion 206*c* is given to an inner peripheral surface of the first portion 206*a*, or an extraction taper is not substantially given to the inner peripheral surface.

In addition, since the dimensions of an external shape of the insulator 202 are the same as those of the insulator 2, the description thereof is omitted. In order to reduce the space for the spark plug 100 or improve the performance thereof, such as a heat generation characteristic, the diameter of the insulator 202 is also made smaller.

Next, a method for manufacturing the insulator 202 will be described. The above-mentioned insulator 202 is manufactured by carrying out a preparing step, a powder filling step, a press pin arranging step, a pressing and forming step, a die releasing step, and a press pin removing step in this order. Hereinafter, the respective steps will be described.

Preparing Step

In the preparing step, the press pin 250 and the forming die 80 are prepared. In addition, since the forming die 80 is the same as that of Embodiment 1, the description thereof is omitted.

Figure 13:
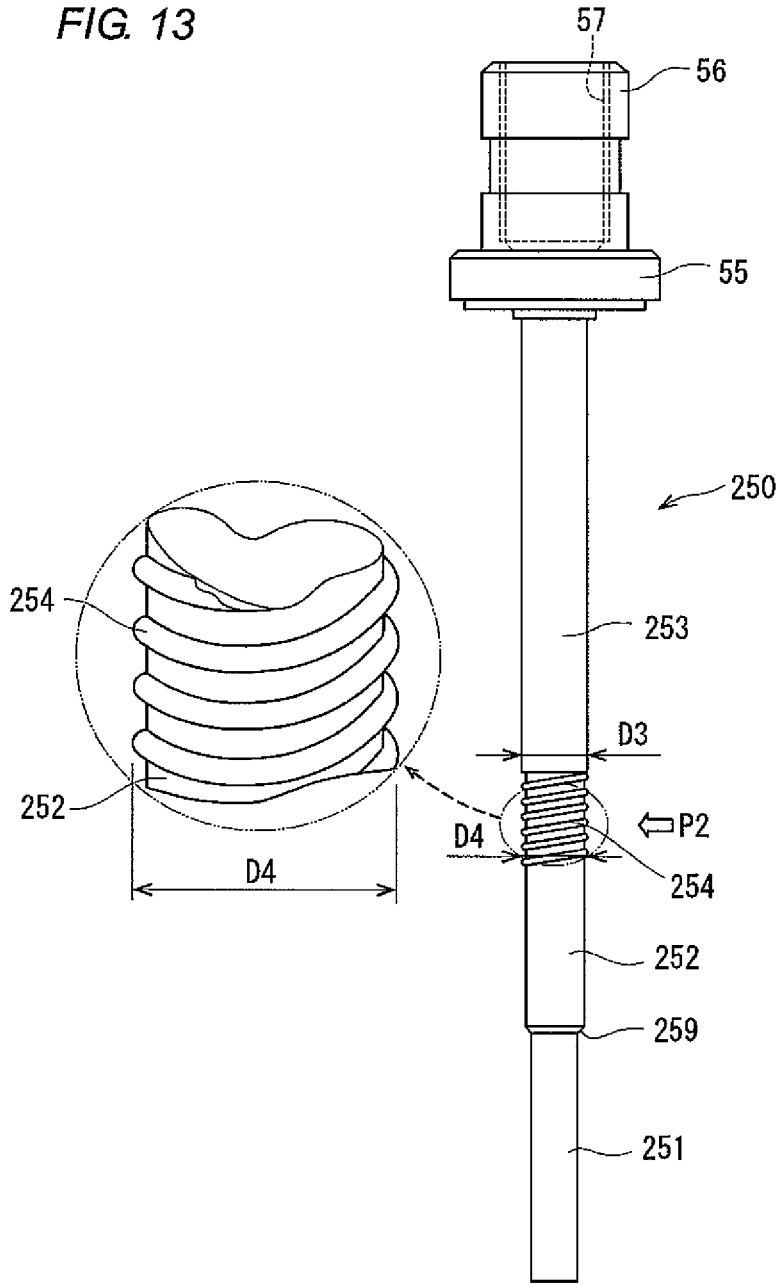
FIG. 13 is a front view of a press pin in the method for manufacturing an insulator for a spark plug of Embodiment 3.

The press pin 250, as shown in FIG. 13, is a metallic shaft body used in order to form the through hole 206. In more detail, the press pin 250 is formed with a first shaft portion 251 for forming the first portion 206*a* of the through hole 206 of FIG. 12 on the leading end side, a second shaft portion 252 for forming the second portion 206*b* of the through hole 206 in a continuous form on the base side of the first shaft portion 251, and a third shaft portion 253 for forming the third portion 206*c* of the through hole 206 in a continuous form on the base side of the second shaft portion 252. Additionally, a stepped portion 259 corresponding to the convex-receiving surface 206*d* of the through hole 206 of FIG. 12 is formed between the first shaft portion 251 and the second shaft portion 252. Moreover, a pin-side spiral portion 254 (which will be described later in detail) is formed at a base end of the second shaft portion 252 in the press pin 50. In addition, a position in the press pin 250 where the pin-side spiral portion 254 is formed is referred to as a "second position P2 (shown in FIG. 13). Description of the second position P2 will be given in a press pin removing step which will be described later.

An extraction taper (for example, about 5/1000 to 5/100 corresponding to the extraction taper of the second portion 206*b* and third portion 206*c*) which has a larger diameter toward the base side in the axial direction is given to outer peripheral surfaces of the second shaft portion 252 and third shaft portion 253. On the other hand, an extraction taper (corresponding to the extraction taper of the first portion 206*a*) with a smaller angle than the second shaft portion 252 and the third shaft portion 253 is given to an outer peripheral surface of the first shaft portion 251, or an extraction taper is not substantially given to the outer peripheral surface. In addition, the mean outer diameter of the first shaft portion 251 is set corresponding to the mean inner diameter of the first portion 206*a*, the mean outer diameter of the second shaft portion 252 is set corresponding to the mean inner diameter of the second portion 206*b* of the through hole 206, and the mean outer diameter of the third shaft portion 253 is set corresponding to the mean inner diameter of the third portion 206*c* of the through hole 206.

Since the press pin 250 is also a very thin shaft body similarly to the press pin 50, the press pin is made of the same material as the press pin 50, and die releasing layers are formed so that troubles, such as bending, are not caused, for example, in a pressing and forming step or the like.

The end face forming portion 55 and the head 56 where the female thread portion 57 is formed in the axial direction are integrally formed similarly to the press pin 50 on the base end side of the third shaft portion 253 of the press pin 250. The above-described upper holder portion 86 is rotatably fitted to the outside of the head 56.

As shown in FIG. 13, ribs are provided at an outer peripheral surface of the base end of the second shaft portion 252 and the pin-side spiral portion 254 so as to protrude spirally. The external diameter D4 of the pin-side spiral portion 254 is made smaller than the external diameter D3 (external diameter on the leading end side of the third shaft portion when an extraction taper is given to the third shaft portion 253) of the outer peripheral surface of the third shaft portion 253 closer to the base end than the pin-side spiral portion 254. In addition, the spiral winding direction of the pin-side spiral portion 254 is reverse to the spiral winding direction of the female thread portion 57.

Powder Filling Step to Die Releasing Step

Since the powder filling step to the die releasing step are the same as those of Embodiment 1, except that the press pin 50 is substituted with the press pin 250, the description thereof is omitted. When the powder filling step to the die releasing step are carried out similarly to Embodiment 1, as shown in FIG. 14, a green body PC2 which is integrated with the press pin 250 is obtained.

Press Pin Removing Step

Figure 14:
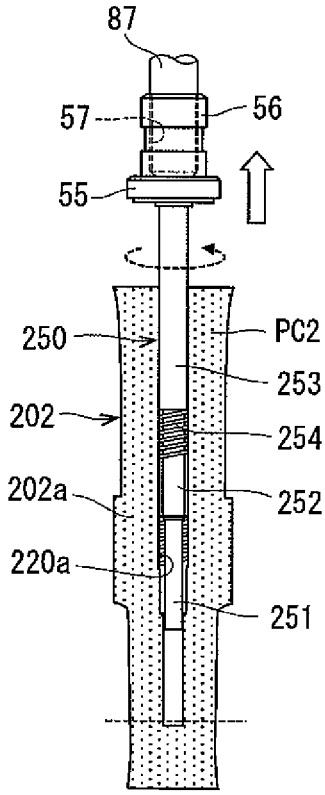
FIG. 14 is an explanatory view showing a step of manufacturing an insulator in the method for manufacturing an insulator for a spark plug of Embodiment 3.

In the press pin removing step, as shown in FIG. 14, the press pin 250 is pulled out from the green body PC2. In more detail, when forming is performed using the press pin 250 in which the pin-side spiral portion 254 is formed, a green body-side spiral portion 220*a* of a shape (that is, a groove shape) obtained by reversing the pin-side spiral portion 254 is formed at the thick-walled portion 202*a* of an inner circumferential surface of the green body PC2 which opposes the pin-side spiral portion 254. As such, the second position P2, that is positioned in the press pin 250 where the pin-side spiral portion 254 is formed, is set such that the green body-side spiral portion 220*a* is located in the thick-walled portion 202*a* of the green body PC2. The thick-walled portion 202*a* remains as it is even if the green body PC2 is sintered and is finally formed into the insulator 202. Additionally, as shown in FIG. 12, the second position P2 is disposed closer to the base end side than a position where the resistor 15 is arranged within the through hole 206 so that the green body-side spiral portion 220*a* does not contact the resistor 15.

Also, as shown in FIG. 14, with the green body PC2 held by an air chunk (not shown), the above-described rotary shaft 87 is rotated in a direction in which it is fastened into the female thread hole 57. Then, the press pin 250 rotates around an axis with respect to the green body PC2, and the press pin 250 threadedly advances and moves up in the extraction direction, on the basis of the screw operation by the engagement between pin-side spiral portion 254 and the green body-side spiral portion 220*a*.

That is, since the press pin 250 moves up slowly by the threadedly advancing operation of the thread while it rotates, an excessive frictional force is hardly generated between the press pin 250 and the inner circumferential surface of the green body PC2 which opposes the outer peripheral surface of the press pin 250, and as a result, the press pin 250 can be extracted smoothly without damaging the green body PC2.

Additionally, since the external diameter D4 of the pin-side spiral portion 254 is smaller than the external diameter U3 of the outer peripheral surface of the third shaft portion 253 closer to the base end than the pin-side spiral portion 254, the pin-side spiral portion 254 does not interfere with the inner circumferential surface of the green body PC2 even after it slips out of the green body-side spiral portion 220*a*. For this reason, the press pin 250 can be extracted without deforming and damaging the green body PC2.

Moreover, since an extraction taper is given to at least the second shaft portion 252 and third shaft portion 253 of the press pin 250, a gap from the inner circumferential surface of the green body PC2 can be obtained, and the press pin 250 can be released easily, only by raising the press pin 250 slightly. If a die-releasing layer, such as a hard-carbon-based die releasing film, is formed at the outer peripheral surface of the press pin 250, it is natural that extraction of the press pin 250 becomes easier.

Figure 15:
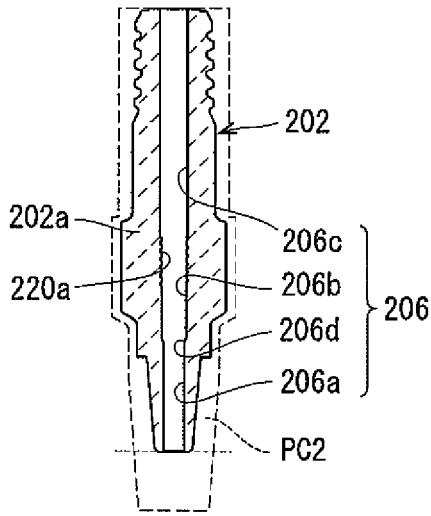
FIG. 15 is an explanatory view showing a step of manufacturing an insulator in the method for manufacturing an insulator for a spark plug of Embodiment 3.

The green body PC2 which has completed the above respective steps and from which the press pin 250 has been extracted, as shown in FIG. 15, has an outer surface machined by grinder cutting or the like, is finished to an external shape corresponding to the insulator 202, and is then sintered at a temperature of 1400 to 1650° C. Accordingly, the inner circumferential surface of the green body PC2 which has opposed the outer peripheral surface of the press pin 250 becomes the through hole 206. Then, the green body is further finished and sintered by applying glaze thereto, whereby the insulator 202 is completed. The central electrode 3 and the terminal electrode 13 are mounted in the through hole 206 of the insulator 202 obtained in this way. Additionally, the resistor 15 is formed by hot pressing or the like between the center electrode 3 and the terminal electrode 13 within the through hole 206. In this case since the second position P2 is set so that the green body-side spiral portion 220*a* does not contact the resistor 15, as shown in FIG. 12, the resistor 15 is provided closer to the leading end than the green body-side spiral portion 220*a*. Then, the insulator 202 is assembled into the metal shell 1 or the like, whereby the spark plug 100 is completed.

Here, in the method for manufacturing the insulator 202 of Embodiment 3, the green body-side spiral portion 220*a* remains at the thick-walled portion 202*a*. Since the thick-walled portion 202*a* is a portion where the wall thickness between the through hole 206 and an outer peripheral surface is greater than other portions in axial direction, deterioration of strength is not caused in the green body PC2 even if the green body-side spiral portion 220*a* remains. For this reason, the strength of the green body PC2 or the insulator 202 is secured, and breakage or the like is less likely in the green body PC2 or the insulator 202.

Additionally, in this manufacturing method, the external diameter D4 of the pin-side spiral portion 254 is made smaller than the external diameter D3 of the outer peripheral surface of the third shaft portion 253 closer to the base end than the pin-side spiral portion 254. For this reason, in this manufacturing method, in the press pin removing step, the pin-side spiral portion 254 does not interfere with the inner circumferential surface of the green body PC2. For this reason, in this manufacturing method, the press pin 250 can be extracted from the green body PC2 without deforming and damaging the green body PC2.

According to the manufacturing method of the insulator 202 of Embodiment 3, similarly to the manufacturing method of Embodiment 1, high yield can be secured even if the diameter of the insulator is made small. As for the spark plug 100 obtained by assembling the insulator 202 and other components together, high yield can be secured, and low manufacturing cost can be realized.

Additionally, in the manufacturing method, the second position P2 is set so that the resistor 15 does not contact the green body-side spiral portion 220*a*. For this reason, even when the resistor 15 is incorporated into the through hole 206 of the insulator 202 by hot pressing or the like, the resistor 15 is formed in a cylindrical shape without being influenced by the green body-side spiral portion 220*a*. For this reason, according to this manufacturing method, the error of the resistance value of the resistor 15 can be prevented from increasing, and the resistor 15 can be made to exhibit predetermined performance reliably.

Although the invention has been described hitherto on the basis of Embodiments 1 to 3, the invention is not limited to the aforementioned Embodiments 1 to 3 and can be suitably changed without departing from the spirit or scope thereof.

The invention is available for a spark plug.

The invention claimed is:

1. A method for manufacturing an insulator for a spark plug which has a through hole extending in an axial direction for receiving a center electrode and a terminal electrode, and comprises a thick-walled portion having a wall thickness defined between the through hole and an outer peripheral surface greater than those of other portions in the axial direction, said method comprising:

preparing a press pin for forming the through hole and a forming die having a cavity, the press pin comprising a rib-shaped pin-side spiral portion formed on an outer peripheral surface of a second position of the press pin;

filling a raw powder into the cavity;

arranging the press pin within the cavity by advancing a leading end of the press pin in the axial direction before, during, or after filling the powder;

pressing the raw powder within the cavity along with the press pin, and obtaining a green body formed with a green body-side spiral portion to which a shape of the pin-side spiral portion is transferred;

releasing the green body along with the press pin from the cavity; and retreating the press pin with respect to the green body while rotating the press pin relative to the green body around an axis, and extracting the press pin from the green body, wherein an outer diameter of the pin-side spiral portion is smaller than an outer diameter of an outer peripheral surface of a portion closer to a base end than the pin-side spiral portion; and wherein the second position is positioned such that the green body-side spiral portion is located within the thick-walled portion.

2. The method according to claim 1, wherein the second position is positioned such that a resistor provided between the center electrode and the terminal electrode does not contact the green body-side spiral portion.

3. A method for manufacturing a spark plug, comprising:

manufacturing an insulator by the method for manufacturing the insulator according to claim 1; and assembling the insulator and other members together.

* * * * *